United States Patent [19]

Itoh et al.

[11] 4,416,536

[45] Nov. 22, 1983

[54] LIGHT MEMORY REMOVING SYSTEM IN AN ELECTROPHOTOGRAPHIC COPYING MACHINE

[75] Inventors: Ikuo Itoh; Shunju Anzai, both of Nara; Kunio Ohashi, Osaka, all of Japan

[73] Assignee: Sharp Kabushiki Kaisha, Osaka, Japan

[21] Appl. No.: 375,175

[22] Filed: May 5, 1982

[30] Foreign Application Priority Data

May 12, 1981 [JP] Japan ..... 56-71595
May 12, 1981 [JP] Japan ..... 56-71597

[51] Int. Cl.[3] ..... G03G 15/00

[52] U.S. Cl. ..... 355/14 R; 355/3 R; 355/14 E; 355/30

[58] Field of Search ..... 355/3 R, 14 R, 14 E, 355/30, 133, 3 DR

[56] References Cited

U.S. PATENT DOCUMENTS 3,966,316 6/1976 Pfeifer et al. ..... 355/3 DR
4,372,668 2/1983 Malachowski et al. ..... 355/3 R
4,376,577 3/1983 Okamoto ..... 355/3 R X

*Primary Examiner*—A. C. Prescott
*Attorney, Agent, or Firm*—Birch, Stewart, Kolasch & Birch

[57] ABSTRACT

An electrophotographic copying machine includes a housing which is separated into an upper body and a lower body along a path of a copy paper in order to facilitate the removal of a jammed paper. When the housing is separated into the upper and lower bodies, a light memory effect is created on a photosensitive drum due to the ambient light. When the upper body is closed after removal of the jammed paper, a light memory removing operation is conducted, wherein a transcription unit and an erase unit are activated without transferring a copy paper.

5 Claims, 7 Drawing Figures

LIGHT MEMORY REMOVING SYSTEM IN AN ELECTROPHOTOGRAPHIC COPYING MACHINE

BACKGROUND AND SUMMARY OF THE INVENTION

The present invention relates to an electrophotographic copying machine wherein a machine body is constructed to be separated into two sections for removing a jammed paper.

The present invention relates more particularly to a light memory removing system in an electrophotographic copying machine, the light memory being produced when the machine body is separated into two sections for removing a jammed paper.

In a conventional electrophotographic copying machine, it was difficult to remove jammed paper or to repair the machine because the operator must remove the jammed paper or secure elements through a thin clearance formed around a photosensitive drum. In order to facilitate the removal of the jammed paper and the repair operation, an electrophotographic copying machine has been proposed, wherein a machine body is constructed to be separated into two sections along a path of copy paper. However, in such a copying machine, a portion of the photosensitive drum is exposed to ambient light when the machine body is separated into two sections. This exposure creates a light memory on the photosensitive drum. The thus created light memory influences the following copying operation. This is because the electric charge is not sufficiently disposed on the photosensitive drum where the light memory is created.

Accordingly, an object of the present invention is to provide an electrophotographic copying machine which ensures a clean copying operation.

Another object of the present invention is to improve an electrophotographic copying machine wherein a machine body is constructed to be separated into two sections along a path of copy paper.

Still another object of the present invention is to provide a light memory removing system in an electrophotographic copying machine wherein a machine body is constructed to be separated into two sections along the path of the copy paper.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a light memory removing system is activated when the machine body is closed after it is separated into two sections along the path of the copy paper. The light memory removing system functions to energize at least a transcription unit and an erase unit without energizing a copy paper transfer system, thereby minimizing the light memory created on the photosensitive drum before initiating an actual copying operation.

In a preferred form, a light memory removing system is activated when a thermal fixing unit reaches a preselected temperature slightly less than the operating temperature. The light memory removing operation is conducted for a period during which the photosensitive drum rotates four (4) revolutions. When the light memory removing operation is completed, the thermal fixing unit reaches the operating temperature.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
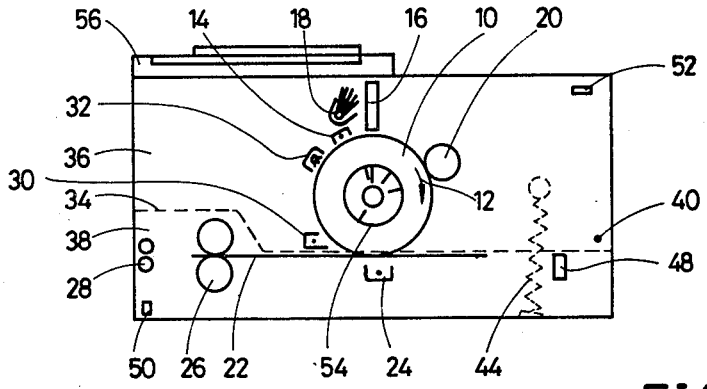
FIG. 1 is a schematic sectional view of an embodiment of an electrophotographic copying machine of the present invention.

An electrophotographic copying machine generally includes a photosensitive drum 10 which is driven to rotate in a direction shown by an arrow 12 in FIG. 1. Image forming units are disposed around the photosensitive drum 10. The image forming units include a corona charging unit 14 for uniformly charging the surface of the photosensitive drum 10, an optical system 16 for forming an electrostatic latent image on the photosensitive drum 10 in combination with an exposure lamp 18. The thus formed electrostatic latent image is developed while it passes through a combined developing-cleaning unit 20. A typical construction of the combined developing-cleaning unit 20 is disclosed in U.S. Pat. No. 3,647,293, entitled "COPYING SYSTEM FEATURING COMBINED DEVELOPING-CLEANING STATION ALTERNATELY ACTIVATED", issued on Mar. 7, 1972.

The thus developed image is transcribed onto a copy paper 22, which is supplied by means of a copy paper supply meachanism, through the use of a transcription unit 24. The transcribed image is fixed by a thermal fixing roller 26 as the copy paper 22 travels therethrough. Then, the copy paper 22 is outputted by means of a pair of paper feed rollers 28. An erase corona unit 30 and an erase lamp 32 are provided for erasing a residual image carried on the photosensitive drum 10. During the second round of the photosensitive drum 10, the combined developing-cleaning unit 20 functions to clean the drum surface as disclosed in the above-mentioned U.S. Pat. No. 3,647,293.

The electrophotographic copying machine of the present invention is constructed to be separated along a dotted line 34 shown in FIG. 1. More specifically, an upper body 36 is rotatably secured to a lower body 38 through the use of a hinge 40. In the normal operational mode, the upper body 36 is tightly secured to the lower body 38 through the use of a locking mechanism 42. A spring 44 is disposed between the upper body 36 and the lower body 38 in order to facilitate the opening of the upper body 36.

Figure 2:
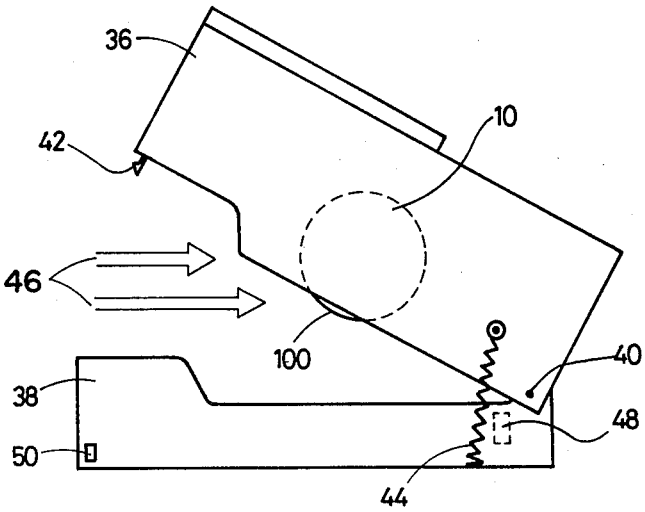
FIG. 2 is a schematic front view showing an open condition of the electrophotographic copying machine of FIG. 1.

FIG. 2 shows a condition where the upper body 36 is opened. The upper body 34 is separated from the lower body 38 substantially along the path of the copy paper 22, thereby facilitating the removal of jammed paper. When the upper body 36 is opened, a portion 100 of the photosensitive drum 10 is exposed to ambient light 46. This will create the light memory on the portion 100 of the photosensitive drum 10.

A microswitch 48 is provided for detecting the opening or closing of the upper body 36. Another microswitch 50 is secured to the lower body 38 for detecting the demounting of a front cover of the electrophotographic copying machine. The front cover is demounted when the operator is forced to remove the jammed paper or to repair the copying machine. A main power switch 52, the microswitch 48 and the microswitch 50 are connected with each other in a series fashion so that the power supply is not conducted if any one of the switches 48, 50 and 52 is in the open state. A timing slit plate 54 is secured to the drive shaft of the photosensitive drum 10 for controlling the operation of the image forming units.

The electrophotographic copying machine of the present invention is the type wherein the thermal fixing roller 26 is rotated in unison with the rotation of the photosensitive drum 10.

When a copy button is actuated in the normal operational mode, the photosensitive drum 10, the timing slit plate 54 and the thermal fixing roller 26 are rotated. A timing signal derived from the timing slit plate 54 is applied to a control circuit in order to first activate the corona charging unit 14. When the leading edge of the image forming section of the photosensitive drum 10 reaches a preselected position (this is detected through the use of the timing slit plate 54), an original carrier 56 is driven to travel, and the exposure lamp 18 is enabled to form the electrostatic latent image on the photosensitive drum 10. The thus formed electrostatic latent image is developed by the combined developing-cleaning unit 20, and the developed image is transcribed onto the copy paper 22 through the use of the transcription unit 24. The residual image on the photosensitive drum 10 is erased by the erase corona unit 30 and the erase lamp 32 while the photosensitive drum 10 continues to rotate. When the photosensitive drum 10 enters into the second rotation, the corona charging unit 14 is not energized. Further, neither the exposure lamp 18 nor the drive system of the original carrier 56 is energized. Accordingly, the electrostatic latent image is not formed on the photosensitive drum 10. The combined developing-cleaning unit 20 functions to clean the surface of the photosensitive drum 10.

The copy paper 22, to which the developed image is transcribed, is separated from the drum surface and transferred to the thermal fixing roller 26. During these operations, when the copy paper 22 is jammed in the path of the copy paper 22, the locking mechanism 42 is released to open the upper body 36, whereby the jammed paper is removed by the operator.

After removing the jammed paper, the upper body 36 is closed and secured to the lower body 38 by means of the locking mechanism 42. While the upper body 36 is opened, the portion 100 of the photosensitive drum 10 is exposed to the ambient light 46. This exposure will create the light memory effects on the portion 100 of the photosensitive drum 10. When the upper body 36 is closed, the microswitch 40 develops a detection signal for activating a light memory removing system of the present invention.

While the upper body 36 is in the open state, the thermal fixing roller 26 is cooled. The thermal fixing roller 26 must be maintained at a preselected temperature in order to conduct a clean copy operation. Thus, the electrophotographic copying machine of the present invention is placed in the preparing mode till the thermal fixing roller 26 reaches the preselected temperature. When the thermal fixing roller 26 reaches a temperature slightly less than the preselected temperature in the preparing mode, the light memory removing system of the present invention is enabled for minimizing the light memory created on the portion 100 of the photosensitive drum 10. When the light memory removing operation is completed, the thermal fixing roller 26 is assumed to have reached the preselected temperature.

Figure 3:
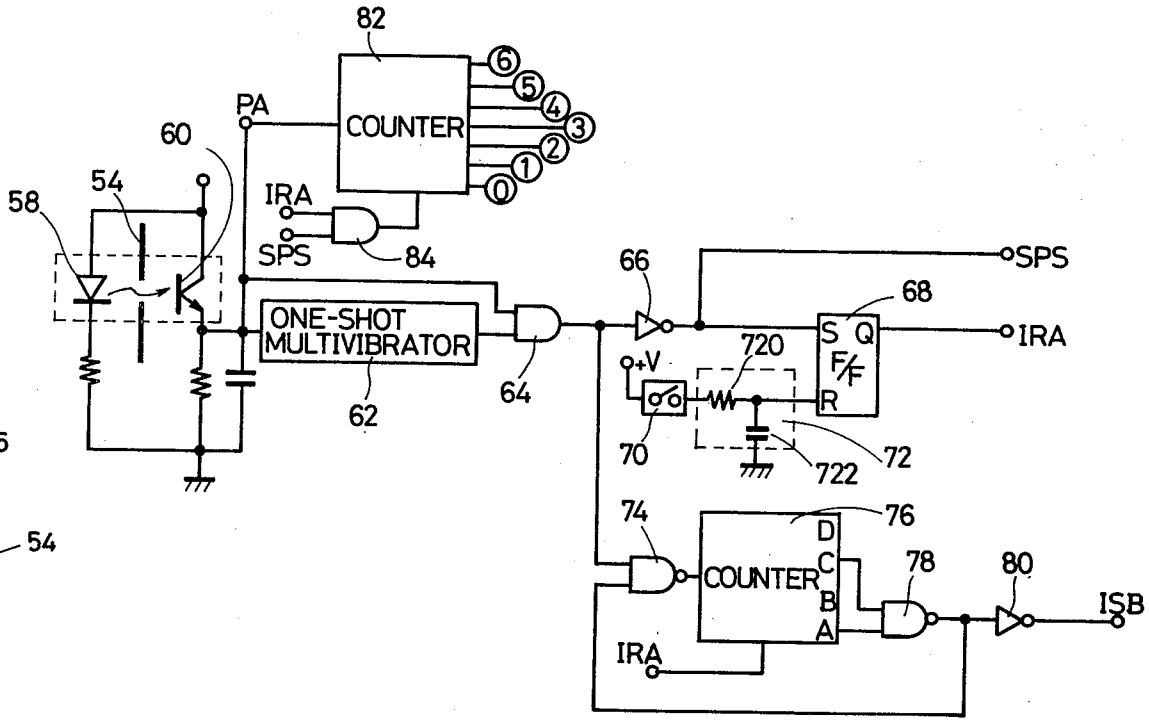
FIG. 3 is a block diagram of an embodiment of a light memory removing control system included in the electrophotographic copying machine of FIG. 1.

FIG. 3 shows an embodiment of a control circuit of the light memory removing system of the present invention.

Figure 4:
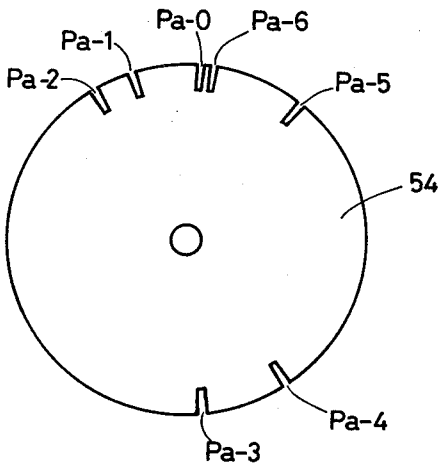
FIG. 4 is a plan view of a timing slit plate included in the electrophotographic copying machine of FIG. 1.

The timing slit plate 54 includes a plurality of slits Pa-0 through Pa-6 as shown in FIG. 4. Each of the slits Pa-0 through Pa-6 is detected by an optical detection system comprising a light emitting diode 58 and a phototransistor 60. FIG. 4 shows the slits required for the light memory removing operation. In an actual system, the timing slit plate 54 further includes additional slits for controlling the actual copying operation such as the driving of the original carrier 56 and the initiation of the copy paper supply. The first slit Pa-0 is provided for determining the leading edge of the photosensitive sheet section of the photosensitive drum 10.

The emitter output of the phototransistor 60 is applied to a one-shot multivibrator 62 and a one input terminal of an AND gate 64. The other input terminal of the AND gate 64 is connected to receive an output signal of the one-shot multivibrator 62. The one-shot multivibrator 62 develops an output signal of the logic "H" for a predetermined period of time T when a slit detection signal PA is developed from the phototransistor 60. The time period T is selected slightly longer than a period of time t provided between a time at which the slit detection signal PA is developed in response to the detection of the seventh slit Pa-6 and a time at which the slit detection signal PA is developed in response to the first slit Pa-0. More specifically, the slit detection signal PA derived from the first slit Pa-0 is developed while the one-shot multivibrator 62 develops the output signal of the logic "H" in response to the seventh slit Pa-6. Accordingly, the AND gate 64 develops an output signal in response to the slit detection signal PA derived from the first slit Pa-0. The output signal of the AND gate 64 is applied to an inverter 66 of which an output signal functions as a start indicating signal SPS for representing the leading edge of the photosensitive sheet section of the photosensitive drum 10.

The start indicating signal SPS is applied to a set input terminal S of a flip-flop 68. The set output signal of the flip-flop 68 functions as an initial reset signal IRA. A switching circuit 70 includes a series connection of the main power switch 52 and the microswitches 48 and 50. A differential circuit 72, including a resistor 720 and a capacitor 722, is connected to a power source +V via the switching circuit 70. A node provided between the resistor 720 and the capacitor 722 is connected to a reset input terminal R of the flip-flop 68. The flip-flop 68 is set or reset when the input signal of the logic "L" is applied to the respective input terminals. Accordingly, when the switching circuit 70 is turned on, the node instantaneously bears the logic "L" and gradually shifts to the logic "H". At the time when the node bears the logic "L", the flip-flop 68 is reset.

The output signal of the AND gate 64 is further applied to one input terminal of a NAND gate 74. An output signal of the NAND gate 74 is applied to a binary counter 76. Output signals developed from output terminals A and C of the binary counter 76 are applied to another NAND gate 78. An output signal of the NAND gate 78 is applied to the other input terminal of the NAND gate 74. The binary counter 75 is reset when the initial reset signal IRA bears the logic "L". The contents stored in the binary counter 76 are increased by one when the output signal of the NAND gate 74 bears the logic "L". That is, the contents stored in the binary counter 76 are increased in response to the generation of the start indicating signal SPS. When the contents stored in the binary counter 76 reach "5" (five), the output terminals A and C develop the output signals of the logic "H" and, therefore, the output signal of the NAND gate 78 changes to the logic "L". Accordingly, the following count operation of the binary counter 76 is interrupted without regard to the generation of the start indicating signal SPS. The output signal of the NAND gate 78 is applied to an inverter 80 of which an output signal functions as a stand-by signal ISB. That is, the stand-by signal ISB is developed when the start indicating signal SPS is counted by five (5) by the binary counter 76.

The slit detection signal PA is further applied to a decimal counter 82. The decimal counter 82 includes a decoder so that the decoded output of the decimal counter 82 functions to activate each of the image forming elements included in the copying machine. The start indicating signal SPS and the initial reset signal IRA are applied to an AND gate 84 of which an output signal is applied to the decimal counter 82 in order to reset the decimal counter 82. That is, the decimal counter 82 is reset when six (6) slit detection signals PA are counted, and restarts the count operation from the second slit Pa-1.

Figure 5:
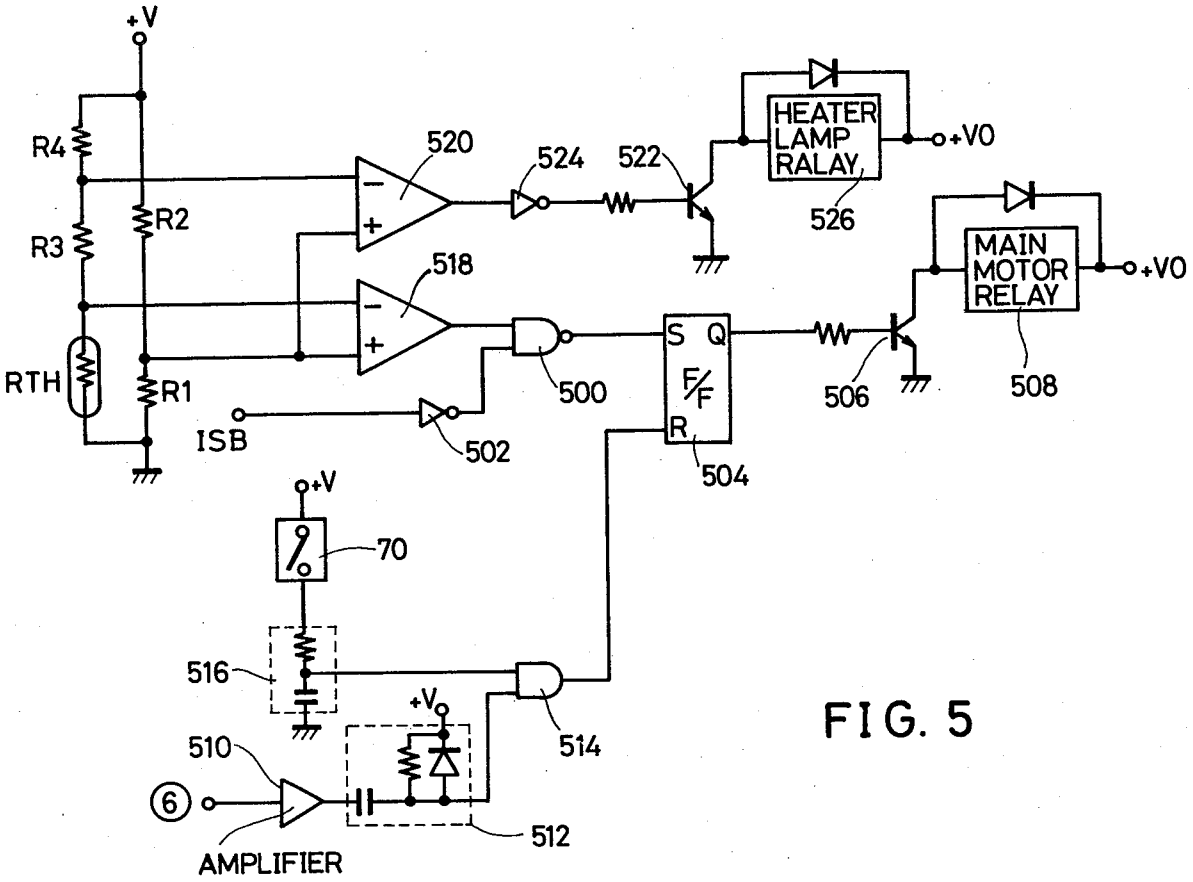
FIGS. 5 and 6 are circuit diagrams of a drive system included in the electrophotographic copying machine of FIG. 1.
Figure 6:
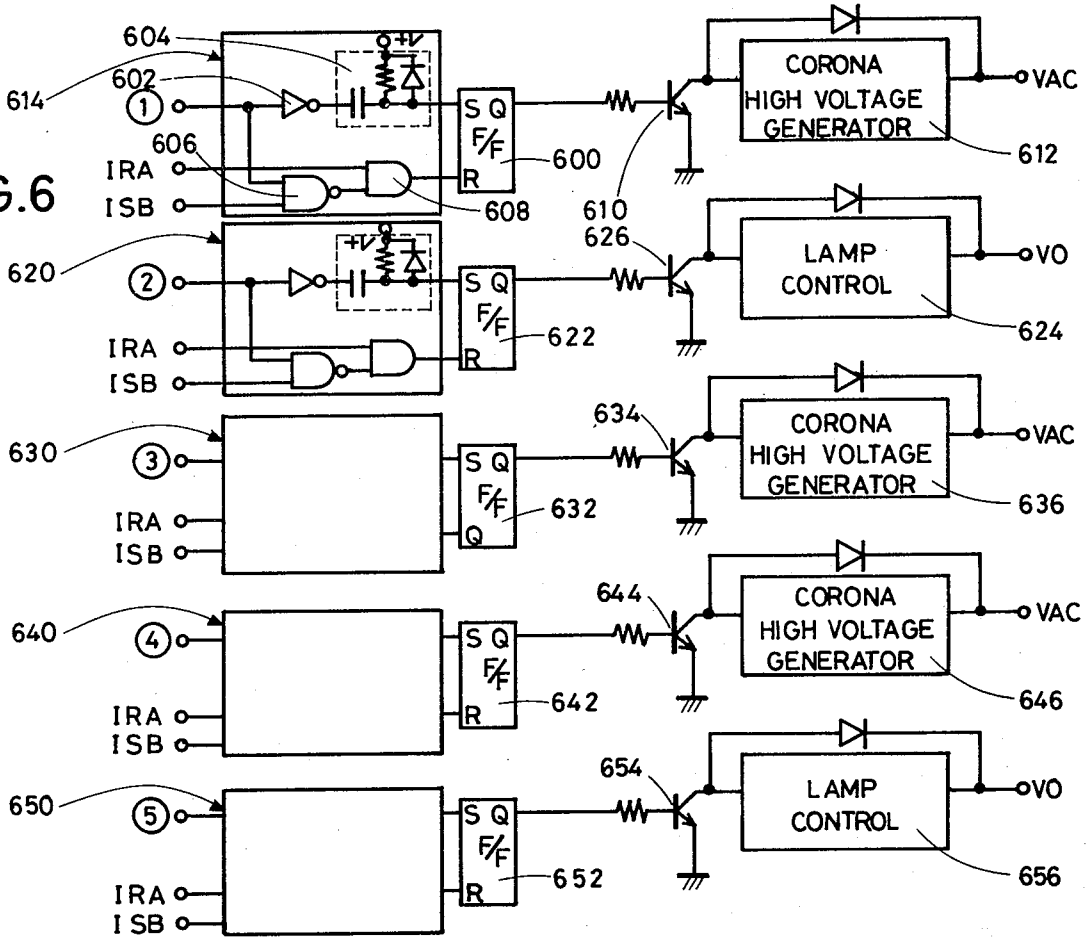

Output signals ⓪ through ⑥ of the decimal counter 82, the stand-by signal ISB and the initial reset signal IRA are used to develop control signals for activating various elements in the electronic copying machine. FIGS. 5 and 6 show the control circuit for developing the control signals.

The stand-by signal ISB is applied to one input terminal of a NAND gate 500 via an inverter 502. An output signal of the NAND gate 500 is applied to a set input terminal S of a flip-flop 504. The set output of the flip-flop 504 is applied to the base electrode of a transistor 506 for controlling the switching operation of the transistor 506. The emitter electrode of the transistor 506 is grounded, and the collector electrode of the transistor 506 is connected to a power source $V_0$ via a main motor relay 508. A reset input terminal of the flip-flop 504 is connected to receive the output signal ⑥ derived from the decimal counter 82 via an amplifier 510, a differential circuit 512 and an AND gate 514. The other input terminal of the AND gate 514 is connected to receive an output signal of another differential circuit 516. The differential circuit 516 is connected to the power source +V via the switching circuit 70. Accordingly, when the power supply is initiated to the copying machine, a reset signal "L" is applied to the flip-flop 504. The flip-flop 504 is constructed to be set or reset by the input signal of the logic "L". When the power source $V_0$ is connected to the main motor relay 508, the contact of the main motor relay 508 is closed to supply power to a main motor which drives the photosensitive drum 10 and the thermal fixing roller 26.

The flip-flop 504 is turned to set when the temperature of the thermal fixing roller 26 reaches 160° C. The copying machine of the present invention is constructed so that the thermal fixing roller 26 is held at 180° C. in the normal operational mode. A comparator 518 is provided for detecting the above-mentioned temperature 160° C. An output signal of the comparator 518 is applied to the other input terminal of the NAND gate 500. A positive input terminal "+" of the comparator 518 receives a voltage $V_{518}(+)$ which is divided by resistors $R_1$ and $R_2$. A negative input terminal "−" of the comparator 518 receives a voltage $V_{518}(-)$ which is divided by resistors $R_4$, $R_3$ and $R_{TH}$.

$$V_{518}(+) = \frac{R_1 \cdot V}{R_2 + R_1}$$

$$V_{518}(-) = \frac{R_{TH} \cdot V}{R_3 + R_4 + R_{TH}}$$

where $R_{TH}$ represents the resistance value of a thermistor which is provided for detecting the surface temperature of the thermal fixing roller 26. The resistance value of the thermistor reduces as the temperature increases. The resistors $R_1$, $R_2$, $R_3$ and $R_4$ are selected so that the following relationship is fulfilled above 160° C.

$$\frac{R_{TH}}{R_3 + R_4 + R_{TH}} < \frac{R_1}{R_1 + R_2}$$

That is, when the surface temperature of the thermal fixing roller 26 becomes higher than 160° C., the voltage $V_{518}(-)$ becomes lower than the voltage $V_{518}(+)$. Therefore, the output signal of the comparator 518 bears the logic "H".

Another comparator 520 is provided for maintaining the surface temperature of the thermal fixing roller 26 at 180° C. which is the normal operational temperature. A positive input terminal "+" of the comparator 520 receives a voltage $V_{520}(+)$ which is identical with the voltage $V_{518}(+)$. A negative input terminal "−" of the comparator 520 receives a voltage $V_{520}(-)$ which is obtained from the node provided between the resistors $R_3$ and $R_4$. An output signal of the comparator 520 is applied to the base electrode of a transistor 522 via an inverter 524. Accordingly, the transistor 522 is placed in the nonconductive condition when the surface temperature of the thermal fixing roller 26 exceeds the set temperature 180° C., thereby precluding the supply of power to a heater lamp relay 526. That is, the resistors $R_1$, $R_2$, $R_3$ and $R_4$ are selected to satisfy the following condition when the surface temperature of the thermal fixing roller 26 is above the set temperature 180° C.

$$\frac{R_3 + R_{TH}}{R_3 + R_4 + R_{TH}} \leqq \frac{R_1}{R_1 + R_2}$$

The output signal ① developed from the decimal counter 82 is applied to a set input terminal S of a flip-flop 600 via an inverter 602 and a differential circuit 604 shown in FIG. 6. A NAND gate 606 is connected to receive the output signal ① and the stand-by signal ISB. An output signal of the NAND gate 606 is applied to one input terminal of an AND gate 608. The other input terminal of the AND gate 608 is connected to receive the initial reset signal IRA. An output signal of the AND gate 608 is applied to a reset input terminal R of the flip-flop 600. The set output of the flip-flop 600 is applied to the base electrode of a transistor 610 for controlling the switching operation of the transistor 610. The emitter electrode of the transistor 610 is grounded, and the collector electrode of the transistor 610 is connected to a power source $V_{AC}$ via a corona high voltage generation circuit 612 which activates the corona charging unit 14. That is, the output signal ① of the decimal counter 82 controls the operation of the corona charging unit 14.

The output signal ② of the decimal counter 82, the stand-by signal ISB and the initial reset signal IRA are applied to a logic circuit 620 which has the same construction as a logic circuit 614 which has been discussed in connection with the output signal ① of the decimal counter 82. Output signals of the logic circuit 620 are applied to a flip-flop 622. The set output of the flip-flop 622 functions to enable a lamp control circuit 624 via a transistor 626. The lamp control circuit 624 activates the exposure lamp 18. That is, the output signal ② of the decimal counter 82 controls the operation of the exposure lamp 18.

The output signal ③ of the decimal counter 82 is applied to a logic circuit 630 which has the same construction as the logic circuit 614. Output signals of the logic circuit 630 are applied to a flip-flop 632. The set output of the flip-flop 632 functions to switch a transistor 634 which enables a corona high voltage generation circuit 636. The corona high voltage genaration circuit 636 activates the transcription unit 24. That is, the output signal ③ of the decimal counter 82 controls the operation of the transcription unit 24.

The output signal ④ of the decimal counter 82 is applied to a logic circuit 640 which has the same construction as the logic circuit 614. Output signals of the logic circuit 640 function to set or reset a flip-flop 642. The set output of the flip-flop 642 functions to switch a transistor 644 which enables a corona high voltage generator 646 associated with the erase corona unit 30. That is, the output signal ④ of the decimal counter 82 controls the operation of the erase corona unit 30.

The output signal ⑤ of the decimal counter 82 is applied to a logic circuit 650 which has the same construction as the logic circuit 614. Output signals of the logic circuit 650 are applied to a flip-flop 652 to set or reset the flip-flop 652. The set output of the flip-flop 652 is applied to a transistor 654 to switch the transistor 654. When the transistor 654 is switched on, a lamp control circuit 656 is enabled for activating the erase lamp 32. That is, the output signal ⑤ of the decimal counter 82 controls the operation of the erase lamp 32.

Figure 7:
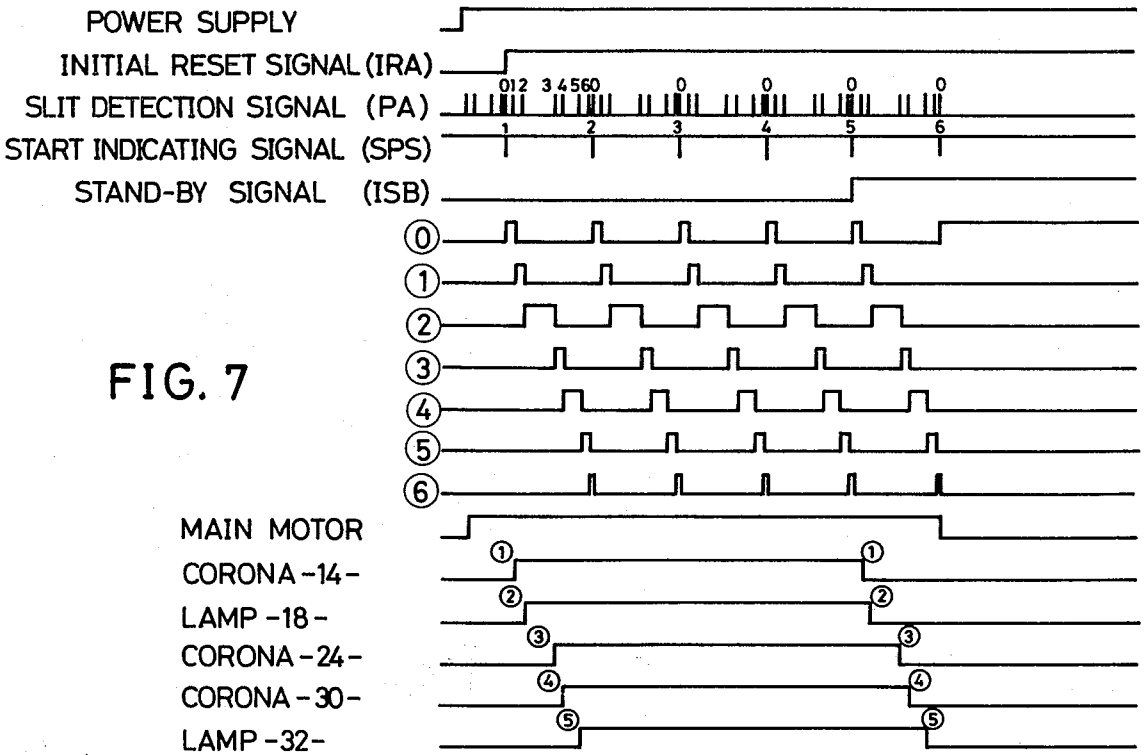
FIG. 7 is a time chart for explaining an operational mode of the light memory removing control system of FIG. 3 and the drive system of FIGS. 5 and 6.

The light memory removing operation will be described with reference to a time chart of FIG. 7.

When the upper body 36 is opened for removing a jammed paper, the microswitch 48 is opened to preclude the power supply to the copying machine. After removing the jammed paper, when the upper body 36 is closed, the microswitch 48 is closed. Then, the front housing (not shown) is secured to the body of the copying machine to close the microswitch 50. At this moment, if the main power switch 52 is in the ON state, an electric current flows to the differential circuit 72 through the switching circuit 70. The flip-flop 68 is reset, whereby the initial reset signal IRA bears the logic "L". In response to the logic "L" of the initial reset signal IRA, the binary counter 76 is reset to force the stand-by signal ISB bear the logic "L". In response to the switching operation of the switching circuit 70, the differential circuit 516 also develops a signal of the logic "L" to reset the flip-flop 504. At this moment, if the surface temperature of the thermal fixing roller 26 is above 160° C., the comparator 518 develops the output signal of the logic "H". The output signal of the NAND gate 500 bears the logic "L" to set the flip-flop 504. However, it is usual that the surface temperature of the thermal fixing roller 26 is below 160° C. when the upper body 36 is closed after the opening for a considerable period of time. Therefore, it is usual that the flip-flop 504 is in the reset state at a time when the switching circuit 70 is switched on.

The heater lamp relay 526 is energized to heat up the thermal fixing roller 26. When the surface temperature of the thermal fixing roller 26 reaches 160° C., the output signal of the NAND gate 500 changes to the logic "L" to set the flip-flop 504. The transistor 506 is switched on to supply power to the main motor relay 508. Accordingly, the photosensitive drum 10 and the thermal fixing roller 26 begin to rotate.

In response to the rotation of the photosensitive drum 10, the slit detection signal PA is developed by means of the timing slit plate 54. The thus developed slit detection signal PA is applied to the decimal counter 82. When the slit detection signal PA derived from the first slit Pa-0 is developed immediately after the development of the slit detection signal PA derived from the seventh slit Pa-6, the one-shot multivibrator 62 develops the output signal of the logic "H". The flip-flop 68 is set via the AND gate 64 and the inverter 66. The start indicating signal SPS (the output signal of the inverter 66) and the initial reset signal IRA (the set output of the flip-flop 68) are applied to the decimal counter 82 via the AND gate 84 to reset the decimal counter 82. In this way, the initial position or the leading edge of the photosensitive sheet of the photosensitive drum 10 is detected. Then, the light memory removing operation is initiated. The start indicating signal SPS is applied also to the binary counter 76 via the NAND gate 74. At this moment, the contents stored in the binary counter 76 become "1".

When the slit detection signal PA is developed in response to the second slit Pa-1, the decimal counter 82 develops the output signal ① which functions to set the flip-flop 600. The power $V_{AC}$ is supplied to the corona high voltage generation circuit 612, whereby the corona charging unit 14 functions to uniformly charge the surface of the photosensitive drum 10.

When the slit detection signal PA corresponding to the third slit Pa-2 is generated, the decimal counter 82 develops the output signal ② to set the flip-flop 622. Thus, the exposure lamp 18 is activated by the lamp control circuit 624. During the light memory removing operation, the original carrier 56 is not driven to travel. Therefore, the uniform light is applied to the surface of the photosensitive drum 10 which has been uniformly charged by the corona charging unit 14.

When the slit detection signal PA corresponding to the fourth slit Pa-3 is generated, the decimal counter 82 develops the output signal ③ to set the flip-flop 632. That is, the transcription unit 24 is activated. However, the copy paper 22 is not supplied during the light memory removing operation. When the slit detection signal PA corresponding to the fifth slit Pa-4 is generated, the decimal counter 82 develops the output signal ④ to set the flip-flop 642. The erase corona unit 30 is activated to erase the residual image. When the slit detection signal PA corresponding to the sixth slit Pa-5 is generated, the decimal counter 82 develops the output signal ⑤ to set the flip-flop 652. The erase lamp 32 is energized.

When the start indicating signal SPS is again developed in response to the completion of one round of the photosensitive drum 10, the decimal counter 82 is reset. Further, the contents stored in the binary counter 76 are changed to "2". The main motor is continuously energized even when the output signal ⑥ is developed from the decimal counter 82 because the stand-by signal ISB bears the logic "L" till the binary counter 76 counts up to "5". Furthermore, the corona charging unit 14, the exposure lamp 18, the transcription unit 24, the erase corona unit 30 and the erase lamp 32 are continuously energized during the light memory removing operation as long as the stand-by signal ISB bears the logic "L" as shown in the time chart of FIG. 7.

When the photosensitive drum 10 completes the four rounds, the contents stored in the binary counter 76 reaches "5" to change the stand-by signal ISB to the logic "H". When the stand-by signal ISB bears the logic "H", the binary counter 76 does not perform the following count operation. When the output signal ① is developed under the condition where the stand-by signal ISB bears the logic "H", the reset input terminal R of the flip-flop 600 receives the reset signal via the NAND gate 606 and the AND gate 608. Accordingly, the operation of the corona charging unit 14 is terminated. In the same way, when the output signal ② is developed from the decimal counter 82 under the condition where the stand-by signal ISB bears the logic "H", the flip-flop 622 is reset to terminate the operation of the exposure lamp 18. The operation of the transcription unit 24, the operation of the erase corona unit 30 and the operation of the erase lamp 32 are terminated when the output signals ③, ④ and ⑤ are developed from the decimal counter 82, respectively, under the condition where the stand-by signal ISB bears the logic "H".

When the output signal ⑥ is developed from the decimal counter 82 under the condition where the stand-by signal ISB bears the logic "H", the flip-flop 504 is reset because the set input terminal S of the flip-flop 504 receives the signal of the logic "H" and the reset input terminal R of the flip-flop 504 receives the signal of the logic "L". Accordingly, the rotation of the main motor is terminated to hold the photosensitive drum 10 at the initial position. That is, the light memory removing operation is completed.

The above-mentioned light memory removing operation is performed when the switching circuit 70 is changed from the off state to the on state. The switching of the switching circuit 70 will occur when, for example, the main power switch 52 is thrown, the microswitch 50 is switched on after the repair operation, or the microswitches 48 and 50 are switched on after the removal of the jammed paper. The light memory removing operation is well performed even though the corona charging unit 14 and the exposure lamp 18 are not activated while the remaining elements 24, 30 and 32 are activated. This modification will be easily constructed by omitting the circuit elements associated with the output signals ① and ②.

[EXAMPLE]

The photosensitive drum 10 has a photosensitive sheet made of an organic semiconductor material. The corona charging unit 14 operates at the discharging voltage of 7.2 KV and the discharging current of 1.2 mA. The photosensitive drum 10 is driven to rotate at the peripheral speed of 150 mm/sec. In the normal operational mode of operation the surface of the photosensitive drum 10 is charged to 500 V by means of the corona charging unit 14.

When the photosensitive drum 10 is exposed to the ambient light of 3000 lx for five (5) minutes and the same charging operation is conducted, the surface potential of the photosensitive drum 10 is reduced to from 40 to 60% due to the light memory effects.

The light memory removing operation is conducted to the photosensitive drum 10 which has been exposed to the above-mentioned ambient light. When the transcription unit 24, the erase corona unit 30 and the erase lamp 32 are activated while the photosensitive drum 10 rotates one (1) round and, then, the above-mentioned charging operation is conducted by the corona charging unit 14, the surface potential of the photosensitive drum 10 is recovered to 85% of 500 V. When the transcription unit 24, the erase corona unit 30 and the erase lamp 32 are continuously activated while the photosensitive drum 10 rotates four (4) rounds and, then, the above-mentioned charging operation is conducted by the corona charging unit 14, the surface potential of the photosensitive drum 10 is recovered to 95% of 500 V. Such a photosensitive drum ensures a clean copy.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electrophotographic copying machine comprising:

a photosensitive drum;

image forming elements disposed around said photosensitive drum, said image forming elements including a corona charging unit, an exposure unit, a developing unit, a transcription unit and an erase unit;

a housing for accommodating said photosensitive drum and said image forming elements, said housing constructed to be separated substantially along a path of a copy paper;

detection means for developing a detection signal when said housing is closed from a separated state;

light memory removing means for activating at least said transcription unit and said erase unit for removing a light memory effect developed on said photosensitive drum while said housing is separated; and a control circuit for enabling said light memory removing means when said detection signal is developed from said detection means.

2. The electrophotographic copying machine of claim 1, further comprising:

a thermal fixing roller fixing a transcribed image;

temperature detection means for detecting a surface temperature of said thermal fixing roller; and a temperature control circuit means for maintaining said surface temperature of said thermal fixing roller at a preselected value.

3. The electrophotographic copying machine of claim 2, further comprising:

a determination circuit means for developing a determination output when said surface temperature of said thermal fixing roller reaches a value slightly lower than said preselected value, wherein said temperature control circuit means includes logic circuit means for enabling said light memory removing means when said determination output is developed by said determination circuit after said detection signal has been developed from said detection means.

4. The electrophotographic copying machine of claim 3, wherein said light memory removing means is enabled while said photosensitive drum rotates four (4) rounds.

5. The electrophotographic copying machine of claim 3, wherein said preselected value is 180° C., and said determination output is developed when said surface temperature of said thermal fixing roller reaches 160° C.

* * * * *